US010281134B2

(12) United States Patent
Grohmann et al.

(10) Patent No.: US 10,281,134 B2
(45) Date of Patent: May 7, 2019

(54) DISHWASHER HAVING INTERIOR LIGHTING

(71) Applicant: BSH Hausgeräte GmbH, Munich (DE)

(72) Inventors: Florian Grohmann, Dillingen (DE); Thomas Tremmel, Finningen (DE); Norbert Gerstner, Herbrechtingen (DE)

(73) Assignee: BSH Hausgeräte GmbH, Munich (DE)

( * ) Notice: Subject to any disclaimer, the term of this patent is extended or adjusted under 35 U.S.C. 154(b) by 102 days.

(21) Appl. No.: 15/461,565

(22) Filed: Mar. 17, 2017

(65) Prior Publication Data

US 2017/0268766 A1 Sep. 21, 2017

(30) Foreign Application Priority Data

Mar. 18, 2016 (DE) ..... 10 2016 204 507

(51) Int. Cl.

| | |
|---|---|
| ***F21V 15/04*** | (2006.01) |
| ***F21V 33/00*** | (2006.01) |
| ***A47L 15/42*** | (2006.01) |
| *F21Y 115/10* | (2016.01) |
| *F21W 131/30* | (2006.01) |

(52) U.S. Cl.

CPC ..... *F21V 33/0044* (2013.01); *A47L 15/4274* (2013.01); *F21V 15/04* (2013.01); *F21W 2131/30* (2013.01); *F21Y 2115/10* (2016.08)

(58) Field of Classification Search

CPC ... F21V 33/0044; F21V 15/04; A47L 15/4274

See application file for complete search history.

(56) References Cited

U.S. PATENT DOCUMENTS

| | | | | |
|---|---|---|---|---|
| 2013/0027214 | A1* | 1/2013 | Eng | A47L 15/4293 340/654 |
| 2014/0376213 | A1* | 12/2014 | Miedema | F21V 33/0024 362/127 |
| 2015/0049455 | A1* | 2/2015 | Heater | A47L 15/4293 362/23.13 |
| 2015/0157184 | A1* | 6/2015 | Alexander | A47L 15/4257 312/319.5 |
| 2016/0045095 | A1* | 2/2016 | Gleixner | A47L 15/4246 134/115 R |
| 2016/0051123 | A1 | 2/2016 | Gleixner et al. | |
| 2016/0291232 | A1* | 10/2016 | Hikmet | F21K 9/61 |

OTHER PUBLICATIONS

National Search Report DE 10 2016 204 507.5 dated Nov. 14, 2016.

* cited by examiner

*Primary Examiner* — Anabel Ton

(74) *Attorney, Agent, or Firm* — Michael E. Tschupp; Andre Pallapies; Brandon G. Braun

(57) ABSTRACT

A dishwasher, in particular a household dishwasher, includes a dishwasher cavity for cleaning dishes, glasses, cutlery or similar wash items. The dishwasher cavity has a plurality of walls that delimit it, with at least one of the walls including a through-hole. A flat lighting unit is configured for placement in the through-hole such as to be pressed by a mechanical force application element against edge regions surrounding the through-hole.

19 Claims, 6 Drawing Sheets

DISHWASHER HAVING INTERIOR LIGHTING

CROSS-REFERENCES TO RELATED APPLICATIONS

This application claims the priority of German Patent Application, Serial No. 10 2016 204 507.5, filed Mar. 18, 2016, pursuant to 35 U.S.C. 119(a)-(d), the disclosure of which is incorporated herein by reference in its entirety as if fully set forth herein.

BACKGROUND OF THE INVENTION

The present invention relates to a dishwasher, in particular a household dishwasher, having a dishwasher cavity for cleaning dishes, glasses, cutlery or similar wash items.

In order to increase the ease of use and monitoring of the cleanness of the cleaned wash items it is desirable to provide interior lighting for the dishwasher cavity. Individual bulbs arranged at points, as are frequently used, for instance, in ovens, are not the optimum solution since numerous shadowed areas are produced in a dishwasher by the dish racks themselves and also by the dishes or other wash items located therein and a point light source has only a slight effect therefore.

At least one large light source is better therefore.

The problem arises there that the light source has to be designed so as to be mechanically stable against pressure from inside. This kind of pressure is produced, in particular, with inappropriate loading, if, for instance, a saucepan handle or a pan handle is pressed with great force again a wall of the dishwasher cavity. The lighting unit must remain mechanically stable and liquid-tight even in this situation. It has been found that gluing large lighting units to a wall can lead to problems here. Furthermore, a lighting unit of this kind must not project too far into the interior since otherwise space that can be used for wash items will be lost.

BRIEF SUMMARY OF THE INVENTION

The invention is based on the problem of making an improvement here.

According to one aspect of the present invention, a dishwasher includes a dishwasher cavity for cleaning dishes, glasses, cutlery or similar wash items, the dishwasher cavity having a plurality of walls that delimit the dishwasher cavity, at least one of the walls including a through-hole, a flat lighting unit configured for placement in the through-hole, and a mechanical force application element configured to press the lighting unit against an edge region surrounding the through-hole.

In accordance with the present invention, a high and long-lasting sealing effect is achieved in that in a generic dishwasher the lighting unit is pressed against edge regions surrounding the through-hole by way of one or more mechanical force application element. Unlike in the case of pure adhesives, there is no need to worry about a reaction with wash liquor either. There is also no change in conditions with continuous operation. A high pressing force of the lighting unit against the edge regions of a through-hole can be achieved by the mechanical force application element to thereby achieve a high deformation of a deformable seal. In this way, the lighting units can be designed so as to be very large and thereby bring about optimally complete lighting of the interior. In particular it is thereby possible for more than 30% of a wall to be occupied by lit surfaces without the tightness or stability becoming a problem as a result.

The respective through-hole or through-hole opening, i.e. the respective opening in the respective wall, is surrounded by edge regions which can preferably be made from the same material and are an integral component of the part of the wall which is left or remains following completion of the through-hole—such as, e.g. cutting out or punching out of wall material. Alternatively, the respective through-hole can be surrounded or enclosed in particular by edge regions which are provided by a separate frame part which is attached to the wall part that is left surrounding the through-hole.

According to another advantageous feature of the present invention, the force application element can press the lighting unit from outside with a force component in a direction of an interior of the dishwasher cavity against the edge region. The force application element can rest, for example, on a housing outer wall or an additional cross-bracing outside of the wall and outside of the dishwasher cavity, and therefore exert a compressive force on the respective lighting unit from the outside.

Conversely it is also possible for the force application element to exert a tensile force in the direction of the edge region of the through-hole. Support from the outside is then unnecessary. The through-hole can be very large and have an edge length of more than 15 to 20 centimeters.

According to another advantageous feature of the present invention, the force application element can penetrate the edge region of the through-hole and be locked on the inside of the wall. A tensile force can then simultaneously be applied in the direction of the wall from the inside and from the outside, so a seal can simultaneously be pressed inwardly and outwardly, further improving the enduring tightness.

Locked screws or pins structured on their outer surface, for example, can be used as the force application element exerting the tensile force, and due to their locking enable secure retention and a defined, adjustable pre-tensioning on the parts fixed therebetween.

The edge region encircling the through-hole advantageously can have a plurality of holes which can be penetrated by corresponding force application elements, for example pins or screws. A plurality of force application elements can therefore be applied uniformly distributed around the through-hole in order to exert the tensile force in the direction of the respective wall. This tensile force then forms a tensioning force.

It is advantageous in this connection to provide at least one hole above and one hole below respectively, and one hole to the right and left of the through-hole respectively in the edge region to ensure a uniform force application all round.

According to another advantageous feature of the present invention, a masking frame can be provided to overlap the force application element on an inside of the at least one of the walls in facing relation to an interior of the dishwasher cavity. This results in a particularly high-quality visual effect. The individual force application element then cannot be seen when looking into the dishwasher cavity.

For a high integration density and a low number of components, the force application element can include an externally contoured pin that penetrates the wall and which can be a component of a modular unit encompassing the masking frame. Therefore, for example, a masking frame made of stainless steel having bolts welded thereto can be supplied for mounting as a pre-assembled modular unit and facilitate mounting considerably due to the appropriate alignment of the bolts with the holes mentioned above.

For good illumination and an attractive visual effect the lighting unit can advantageously include a transparent surface, made for example from transparent glass or acrylic glass, that can be lit by LED.

At its edge region, a plurality of LED units can be associated with this surface that can be illuminated. The units therefore inject light from the end faces and distribute it diffusely over the surface. The colors can be adjusted in the process.

For mechanical stability, the lighting unit advantageously includes a rear holding frame, so that the force does not have to be introduced into the illuminable surface that is made from rather sensitive material. Instead the force application element can act directly on the holding frame which can also engage all over behind the surface that can be illuminated.

According to another advantageous feature of the present invention, a seal can be associated with the lighting unit, with the seal encircling the through-hole of the at least one of the walls and being deformable when subjected to pressing. In this way, a uniform and completely closed seal can be achieved around the through-hole.

Uniform illumination of the dishwasher cavity can be easily achieved when at least one lighting unit is associated with a back wall of the dishwasher cavity located opposite a door. It may then also be sufficient to associate one or more lighting unit(s) with just this one wall.

Advantageously, a pattern of a plurality of lighting units side by side and/or one above the other can be associated with at least one of the walls. Advantageously, more than 30% of the surface of the wall is occupied by lighting units which can still each be relatively small and stably supported.

A pattern of this kind can include, for example, two lighting units side by side and three lighting units one above the other to obtain a large overall illuminated surface on the one hand and to not allow the individual lighting units to become too big on the other hand.

For high stability, each lighting unit advantageously can have a rectangular shape with edge lengths between 15 and 20 centimeters.

According to another advantageous feature of the present invention, the through-hole or cutout can be provided in the at least one of the walls at a location where the at least one of the walls has originally impressed fields or troughs following its manufacture. This results in an increase of its inherent rigidity. Consequently, the stay bars provided in the wall originally all over the entire surface are retained between the openings. The original wall construction can advantageously be retained and the through-hole can be easily cut out or punched out therefrom, and this is advantageous in terms of manufacturing.

Further advantages and features result from exemplary embodiments of the subject matter of the invention illustrated in the drawings and described below.

DETAILED DESCRIPTION OF EXEMPLARY EMBODIMENTS OF THE PRESENT INVENTION

Figure 1:
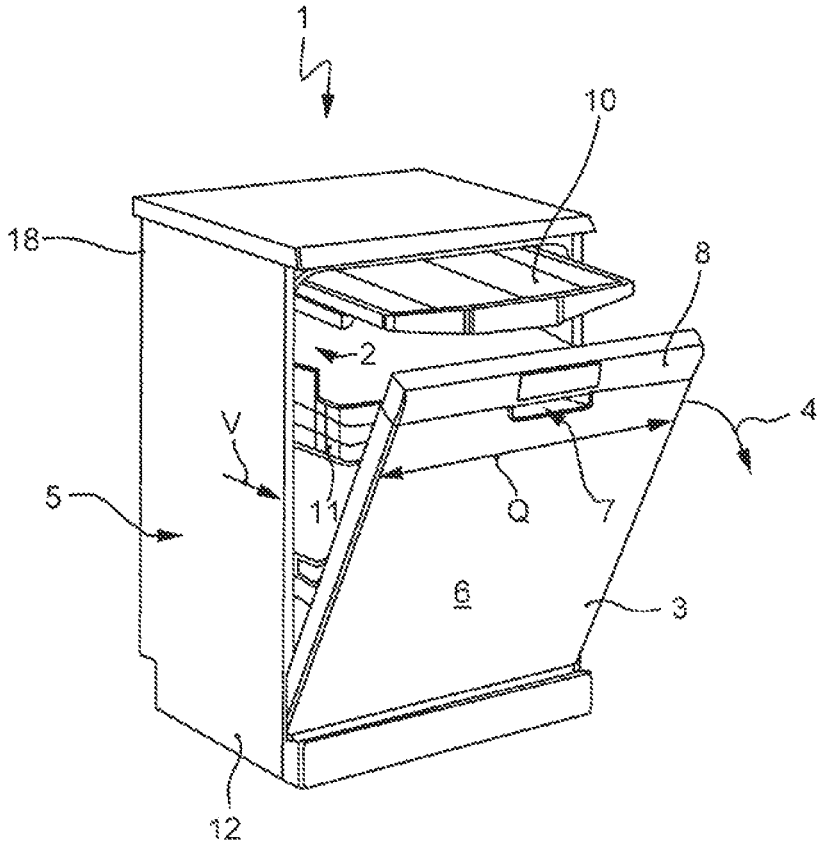
FIG. 1 shows a schematic perspective view obliquely from the front of an embodiment of a dishwasher having a door at the front here.

The dishwasher 1 shown schematically in FIG. 1 is a household dishwasher and has as a component of a partially externally open or closed carcass 5 a dishwasher cavity 2 for receiving wash items to be processed such as, among others, dishes, saucepans, cutlery, glasses, cooking utensils. The wash items can be held for example in dish racks 11 and/or a cutlery drawer 10 and be impinged upon by what is known as washing liquor. Washing liquor is taken to mean fresh water or, in particular, water circulating during operation, with or without detergent and/or rinse aid and/or drying agent. The dishwasher cavity 2 can have an at least essentially rectangular outline with a front side V that faces a user in the operating position. This front side V can form part of a kitchen front comprising kitchen cabinets located side by side, or, in the case of a standalone device, also with no relation to other furniture.

The dishwasher cavity 2 can be closed, in particular at this front side V, by a door 3. This door 3 is shown in FIG. 1 in a partially open position and then in a position obliquely to the vertical. In its closed position, it is upright, by contrast, and, according to the drawing, to open it can be pivoted forwards and downwards about a bottom horizontal axis and in the direction of the arrow 4, so in a completely open position it is at least nearly horizontal.

At its outer and front side V, which is vertical and faces the user in its closed position, the door 3 can be provided with a decorative plate 6 to thereby receive a visual and/or haptic enhancement and/or an adjustment to surrounding kitchen cabinets.

The dishwasher 1 is designed here as a standalone or what is known as a partially integrated, or also as a fully integrated, appliance. In the latter case the carcass 5 can also essentially end with the outer walls of the dishwasher cavity 2. A housing that externally surrounds this can then be unnecessary. A base 12 for receiving functional elements in particular can be located in the lower region of the dishwasher 1.

In the exemplary embodiment according to the drawing, a control panel 8 extended in the transverse direction Q of the dishwasher 1 is associated with the moveable door 3 in its upper region, and this can comprise an access opening 7, which is accessible from the front side V, for manually opening and/or closing the door 3. In the transverse direction Q the dishwasher frequently has an extension of 45, 50 or 60 centimeters. In the depth direction of the front side V to the back the extension is often similarly about 60 centimeters. The values are not imperative.

When the door 3 is closed, the dishwasher cavity 2 is delimited by a total of four vertical walls 13 and two horizontal walls 13 of which one forms a ceiling and a further wall forms a base of the dishwasher cavity 2. With its inner door, the closed door 3 itself forms one of the vertical walls 13.

Figure 2:
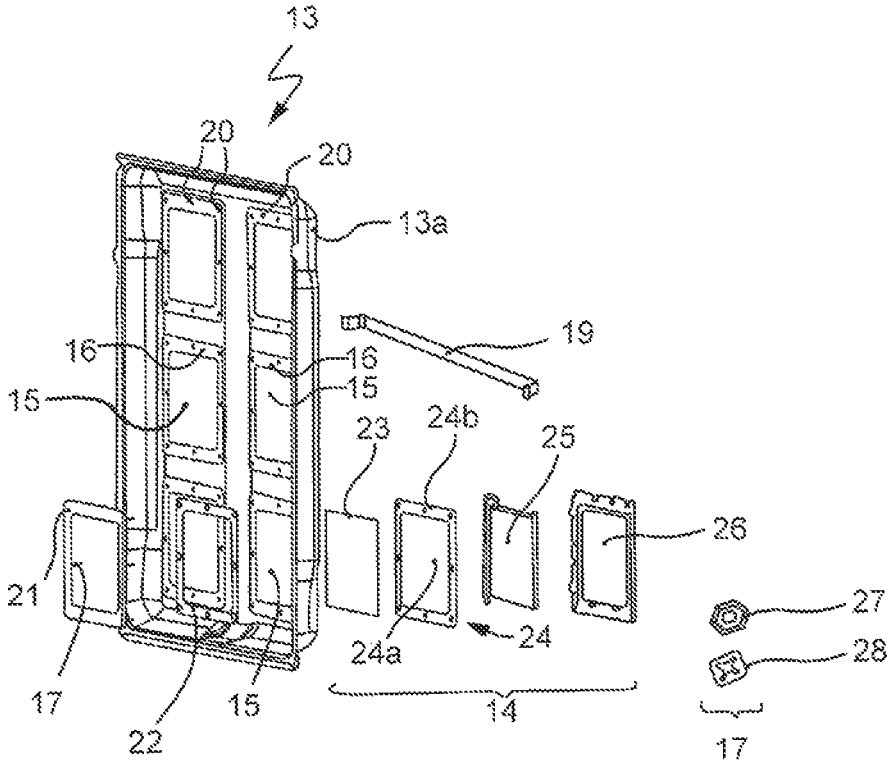
FIG. 2 shows a separately drawn, perspective diagram of a wall of the dishwasher cavity, here a back wall, having a pattern of six lighting units, of which one is shown in an exploded view.

FIG. 2 shows a separately drawn wall 13, here by way of example a back wall opposite the door 3, with lighting units 14 that will be described in more detail below. This wall 13 could additionally or alternatively also be formed by an upper ceiling of the dishwasher cavity 2 or by a side wall located to the side of the door 3. It would also be possible to provide the inside of the door itself in an inventive manner with lighting units 14. Of course, it is also possible to distribute lighting units 14 over a plurality of walls 13.

The light emitted by the lighting units 14 radiates into the dishwasher cavity 2.

At least one through-hole 15, each having an essentially flat lighting unit 14 for the dishwasher cavity 2, is associated with at least one of these walls 13. In FIG. 2, by way of example a plurality of through-holes 15 is arranged side by side and a plurality of through-holes 15 is arranged one above the other. It is alternatively also possible that, for example, only one large lighting unit 14 is associated with the wall 13. The distribution of the illuminated surface in a plurality of smaller lighting units 14, as shown here, denotes a gain in mechanical stability, however. Furthermore, the six "compartments" are already present in conventional back walls 13*a* to increase stability, so only the recesses 15 still need to be punched out, otherwise the back wall 13*a* remains unchanged, however. A design with three large lighting units 14 one above the other and which are each broadly extended is alternatively also advantageous. In particular, the vertical middle lighting units 14 shine through between an upper and a lower dish rack 11 and in this way form good illumination of the dishwasher cavity 2 even with heavy loading.

By way of example, as mentioned, even nowadays a back wall 13*a* has a plurality of recessed compartments in order to reinforce it. The compartments are punched out to form trough-holes 15 here. Each through-hole 15 is surrounded by an edge region 16 which is preferably an integral component of the respective wall 13. The through-holes 15 make it possible to arrange the lighting unit 14 on the outer side of the respective wall 13 and not necessarily in the dishwasher cavity 2, and enable the light to shine through the large through-holes 15. It is also possible to arrange the lighting units 14 on the inside of the respective wall 13, although then the thickness of the lighting units 14 themselves means space is lost for wash items. In this respect external attachment is particularly advantageous.

In order to obtain impermeability to liquids and long-term stability despite the large through-holes 15, the lighting unit(s) 14 is/are pressed by one or more mechanical force application elements 17 against the edge region 16 surrounding the through-hole 15. Like the entire wall 13, the edge region 16 is formed, for example, from stainless steel. The mechanical force application elements 17 do not require chemical adhesion or similarly adhesive effects in the manner of an adhesive. Instead they are detachable modular units which can be attached or inserted separately.

It is possible that the force application element 17 presses the respective lighting unit 14 with a force component from outside in the direction of the interior of the dishwasher cavity 2 against the edge region 16, i.e. the force application element 17 exerts a compressive force on the respective lighting unit 14. For this purpose, the force application element 17 can be designed as an optionally adjustable pressure body—not shown—and rest, for example, on the inside on an outer housing wall 18 in order to exert the inwards pressure from there. Support on a cross-bracing 19 is additionally or alternatively possible.

It is likewise additionally or alternatively possible—and shown here—, that the force application element 17 exerts a tensile force on the respective lighting unit 14 in the direction of the edge regions 16 of the through-hole 15. For this the force application element 17 penetrate the edge regions 16 through holes 20 and are locked on the opposing side of the wall 13. The force then acts perpendicularly to the edge regions 16 of the through-holes 15.

Figure 6:
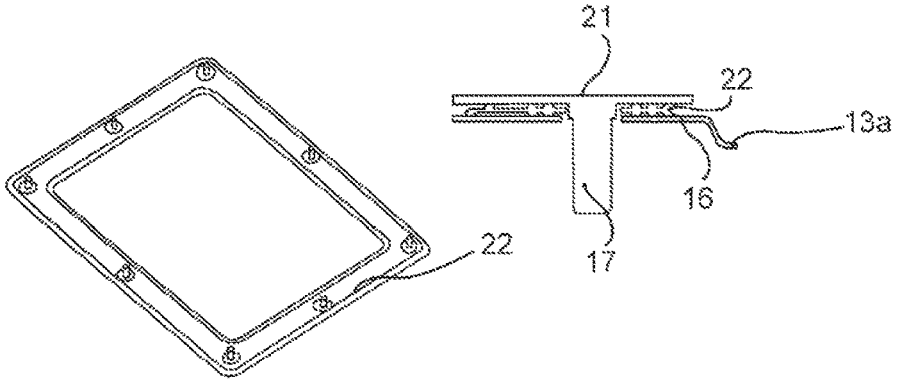
FIG. 6 shows an overall view of an encircling silicone seal which can be penetrated by a force application element.
Figure 7:
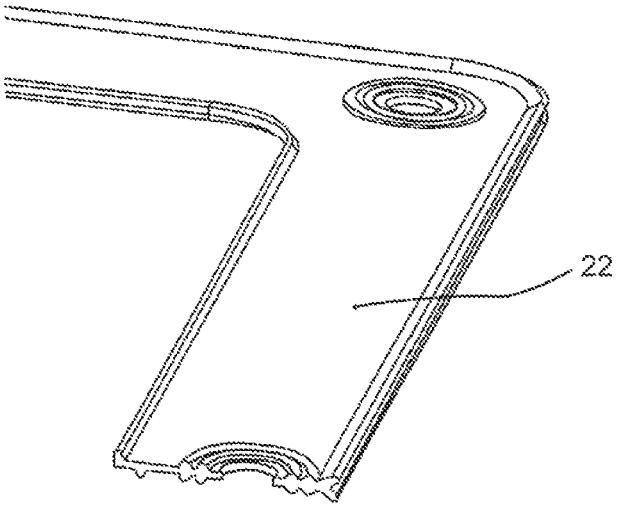
FIG. 7 shows a detailed view of the seal according to FIG. 6, cut here in the region of a recess for penetration of a force application element, in particular a pin, a bolt, a screw or the like, FIG. 8 shows the wall according to FIG. 5 in a view from inside, but after mounting of the lighting units.
Figure 9:
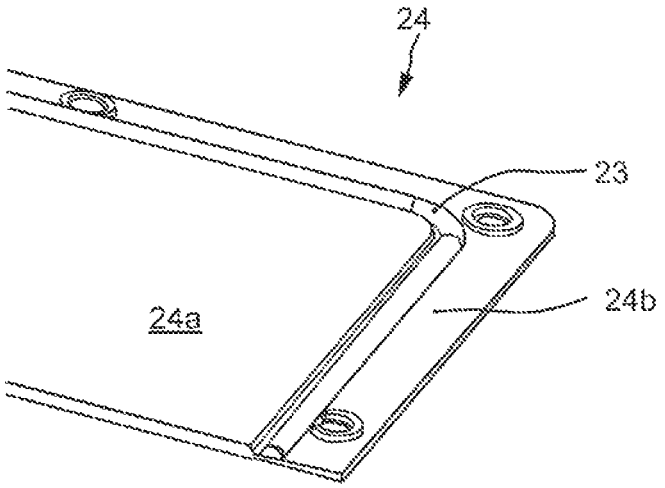
FIG. 9 shows a perspective and truncated view of a window arranged in front of the surface that can be illuminated, which is circumferentially graduated in its edge regions and is provided with recesses for the penetration of force application elements.

Here the force application elements 17 exerting the tensile force are formed in the drawing by locked screws or similar pin-like penetration elements. As is also apparent from FIG. 6, the force application elements 17 extend from a masking frame 21 on the inside of the wall 13 through an inner seal 22, shown on an enlarged scale in FIG. 7, and through holes 20 in the wall 13 to the opposing side, i.e. the outer side of the wall 13 here. There they penetrate a sealing window 24, shown on an enlarged scale in FIG. 9 and sealed by an outer seal 23, extend outwards past a flat light panel 25 and penetrate further a full-surface holding frame 26 that covers them at the back before they are locked therebehind by pushed-on, snapped-on or twisted-on securing elements 27.

Figure 5:
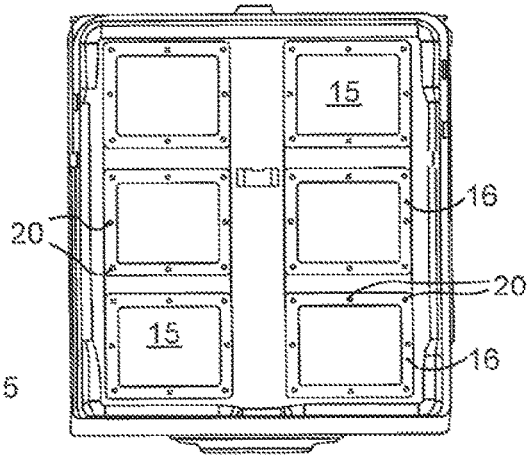
FIG. 5 shows a view from inside of a wall of the dishwasher cavity which is provided with three lighting units one above the other and two lighting units side by side before mounting thereof.

To enable this construction the edge region 16 has a plurality of holes 20 encircling the respective through-hole 15, in the exemplary embodiment eight per through-hole, as shown in FIG. 5: at least one hole above and one hole below respectively, and one hole to the right and left respectively of the through-hole 15 in the edge region 16. Here an additional four holes are also provided in the four corners of the edge region 16, so, overall, each through-hole 15 is provided in its edge region 16 with eight holes 20.

Figure 8:
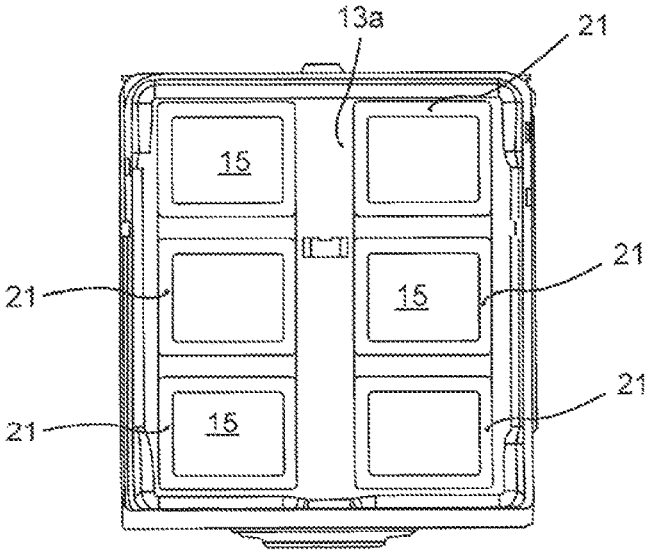

As already indicated, the force application elements 17 are overlapped by a masking frame 21 at the inside of the wall 13 facing the interior of the dishwasher cavity 2. The masking frame 21 provides a smooth, high-quality visual impression, so that the view from inside renders the force application elements 17 invisible. This is readily apparent from FIG. 8. The masking frame 21 can be made, for example, from stainless steel. Force application elements 17 welded or integrally formed perpendicularly on the masking frame 21 extend therefrom as externally contoured pins, bolts, screws or similar penetration elements which penetrate the wall13 and therefore form an integral component of a modular unit comprising the masking frame 21. The masking frame 21 therefore fulfills a visual function as well as a mechanical function by forming an internal locking function for the penetration elements.

The penetration elements can theoretically also be welded to the edge region 16 themselves so as to point outwards, so the holes 20 could then be omitted and the through-holes 15 would not require any further components on the inside. This kind of processing of a wall 13 would be laborious and expensive, however.

The penetration elements shown here firstly penetrate an encircling, annular inner seal 22 adjusted to the size of the through-hole, and made for example of silicone (elastic, but strong and pre-fabricated). This inner seal 22 has the task of sealing the holes 20 so no water passes through there. In addition, thickened edge regions are provided on the outside of the seal as sealing lips in order to prevent the penetration of dirt particles. By contrast, the seal of the through-hole 15 can—but does not have to—be provided on the outer side of the wall 13 to thereby restrict the interior as little as possible. Only the masking frame 13 with the integrally formed force application elements 17 and the seal 22 are then located on the inside of the wall 13 before the force application elements 17 then outwardly penetrate the holes 20 in the wall 13. The inner seal 22 also isolates the masking frame 21 from the wall 13 galvanically to thereby avoid crevice corrosion.

Figure 3:
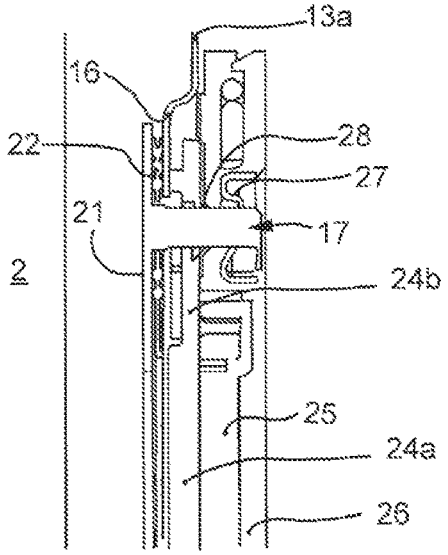
FIG. 3 shows a section through an edge region of a through-hole in the wall with lighting unit attached thereto.
Figure 4:
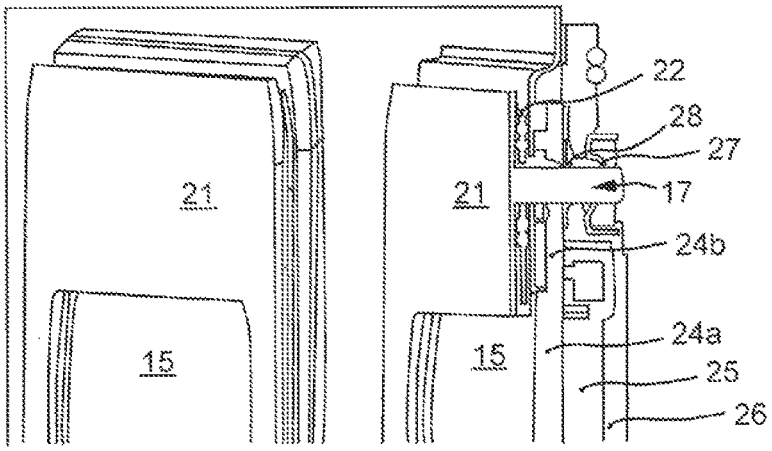
FIG. 4 shows a perspective and, furthermore, truncated view of a section of the wall having two or more through-holes side by side here.
Figure 10:
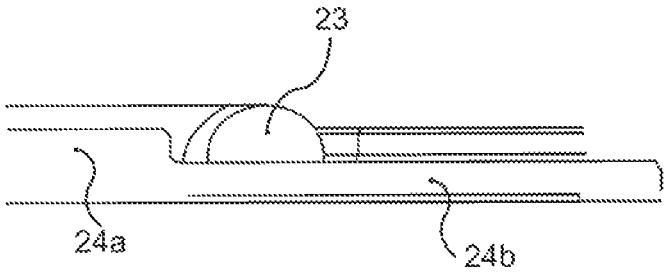
FIG. 10 shows a section along the line X-X in FIG. 9 before mounting.
Figure 11:
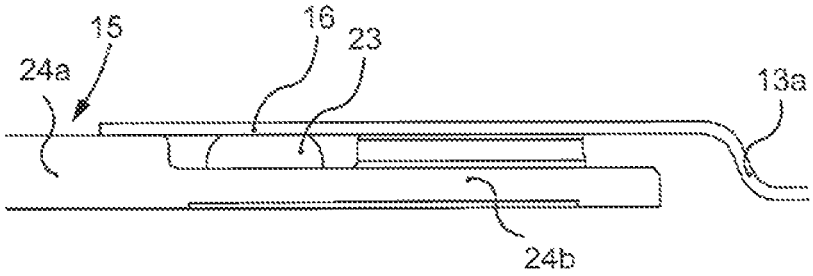
FIG. 11 shows the section according to FIG. 10 when resting at the edge region of a wall of the dishwasher cavity and simultaneous deformation of the seal.

As shown in FIGS. 3 and 4, on the outer side each of the force application elements 17 firstly passes through a graduated transparent sealing window 24 whose central, thicker region 24*a* engages in the through-hole 15 and whose reduced edge region 24*b* is provided with recesses aligned with the holes 20 for passage of the force application element 17. During mounting an encircling outer seal, for example a liquid silicone seal 23, is applied to the flatter edge region, with which seal the through-hole 15 is outwardly sealed against the ingress of liquid. The encircling shoulder also prevents adhesive from escaping (liquid seal 23) into the viewing area. In the mounted state this outer seal 23 is pressed against the wall 13 and elastically deformed in the process, as can clearly be seen, for instance, in the transition from FIG. 10 to FIG. 11. The sealing window 24 is pressed by spring nuts 28 against the wall 13 and thereby forms a mechanically stable unit which retains its position even if parts located further out are disassembled, and this is particularly advantageous for maintenance. The sealing window 24 can be made, for instance, from glass or acrylic glass or a similar material, such as, for instance, Trogamid CX 7323 (Evonik), which is very resistant to liquor. The back of the sealing window 24 is provided with an erosion structure.

Outside of the transparent sealing window 24, i.e. even further from the wall 13, a transparent surface 25 that can be illuminated by LED, what is known as a light panel, is provided in a planar manner behind the sealing window. At its edge region, a plurality of LED units are associated with this surface 25 which can be illuminated, for example top and bottom, which introduce the light into the light panel 25. Each of these LED units comprises, for example, eight LEDs, which irradiate directly into the edge of the light panel 25. To avoid possible light spots due to air and moisture pockets, the direct contact surfaces of the light panel 25 are highly polished. As a result, the lighting unit 14 is independent of slight component distortion due to the introduction of heat. The LED units themselves are located behind the edge region 16, so only the uniformly irradiating surfaces of the light panel 25 can be discerned through the through-holes 15, without seeing individual light spots of the LEDs.

As the back termination, the lighting unit 14 comprises a rear holding frame 26 which engages completely behind the light panel 25 even further out (remote from the wall 13). On its inner side facing the light panel 25, this light panel is preferably white or silver for good light reflection and is likewise penetrated at its edges by the force application elements 17, which are thus locked behind the holding frame 26 and therefore hold the entire package together and press it against the wall 13. Locking occurs by way of the detachable securing elements 27, for example nuts or latching elements. The holding frame 26 is also provided with locking hooks or the like, enabling ordered cable routing.

When the securing elements 27 are disassembled, only the holding frame 26 and the light panel 25 located in front detach, the parts (sealing window 24 and outer seal 23) located further from the wall remain fixed, by contrast. All electrical parts can therefore be replaced without jeopardizing the mechanical stability or the tightness. This is particularly advantageous in terms of servicing. A fitter can therefore disassemble the outer housing wall, for instance, and then remove a corresponding light panel 25 with electrical connections and LED units from behind without having to worry that this might potentially cause a leak. A design of this kind is therefore dual-locked: firstly behind the seal unit 21, 22, 17, 23, 24, and then behind the electrical unit 25, 26.

Figure 12:
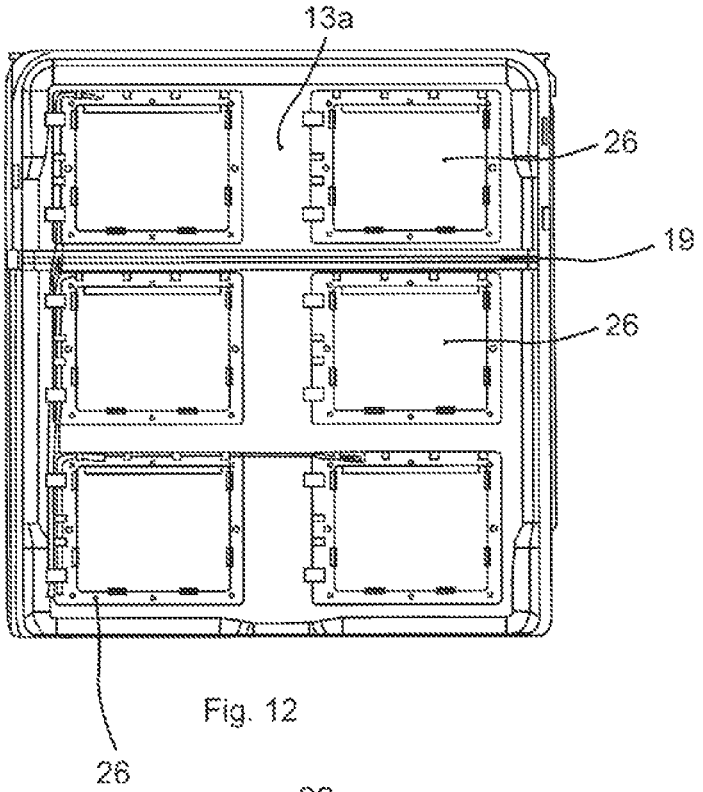
FIG. 12 shows the wall in a view from behind with mounted lighting units and a mounted cross-bracing.
Figure 13:
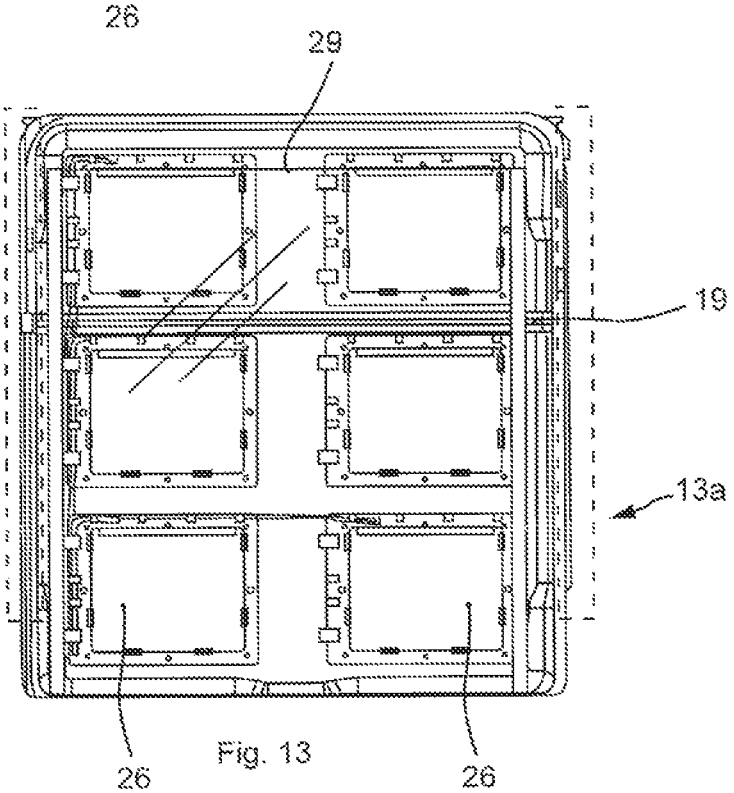
FIG. 13 shows a similar view to FIG. 12 having an additional mounted film as a splash guard.

As shown in FIGS. 12 and 13, a cross-bracing 19 that ensures the rigidity of the wall 13 despite the weakening due to the through-holes 15 and holes 20 can also be attached behind the lighting units 14. This is fixed with screws in the rebate area of the wall 13.

Outwardly a loose splash guard film 29 (FIG. 13) which is held at the top can then be finally provided, and this diverts potential spray downwards into the sump of the appliance. This is firstly intended as a protection for the components during container transport on the conveying devices. Secondly, in the event of potential leaks, the escaping water should be purposefully diverted into the base support without damage to the surroundings and dishwasher.

As described above, the lighting units 14 can be distributed in different ways in the dishwasher cavity 2. In particular, one or more lighting unit(s) 14 are associated with a vertical back wall 13 of the dishwasher cavity 2 opposite a door 3, as is also shown in FIG. 2. Distribution over a plurality of walls 13 is possible.

In FIG. 2 a pattern of a plurality of lighting units 14 side by side and/or one above the other is associated with at least one wall, here in such a way that two lighting units 14 are provided side by side and three lighting units 14 one above the other. As a compromise between maximum illuminated surface and good stability and tightness these each have as rectangles edge lengths between 15 and 20 centimeters. Depending on the width of the dishwasher 1 these can be vertical or horizontal rectangles. Other shapes, such as, for example, round through-holes, are of course basically also possible.

What is claimed is:

1. A dishwasher, comprising:

a dishwasher cavity for cleaning dishes, glasses, cutlery or similar wash items, said dishwasher cavity having a plurality of walls that delimit the dishwasher cavity, at least one of the walls including a through-hole;

a flat lighting unit configured for placement in the through-hole; and a mechanical force application element configured to press the lighting unit against an edge region surrounding the through-hole without using an adhesive, wherein the mechanical force application element is configured to penetrate the edge region and is locked on an opposing side of the at least one of the walls.

2. The dishwasher of claim 1, constructed in the form of a household dishwasher.

3. The dishwasher of claim 1, wherein the force application element is configured to press the lighting unit from outside with a force component in a direction of an interior of the dishwasher cavity against the edge region.

4. The dishwasher of claim 1, wherein the force application element is configured to exert a compressive force on the lighting unit.

5. The dishwasher of claim 1, wherein the force application element is configured to exert a tensile force in a direction of the edge region of the through-hole.

6. The dishwasher of claim 5, wherein the force application element to exert the tensile force is formed by at least one of a locked screw or other pin-shaped penetration element.

7. The dishwasher of claim 1, wherein the edge region has a plurality of holes encircling the through-hole for receiving corresponding ones of said force application element.

8. The dishwasher of claim 7, wherein at least one of the holes in the edge region is provided above the through-hole, at least one of the holes in the edge region is provided below the through-hole, at least one of the holes in the edge region is provided to the right of the through-hole, and at least one of the holes in the edge region is provided to the left of the through-hole.

9. The dishwasher of claim 1, further comprising a masking frame configured to overlap the force application element on an inside of the at least one of the walls in facing relation to an interior of the dishwasher cavity.

10. The dishwasher of claim 8, wherein the force application element comprises an externally contoured pin or screw which penetrates the at least one of the walls and is an integral component of a modular unit encompassing the masking frame.

11. The dishwasher of claim 1, wherein the lighting unit comprises a transparent surface configured for illumination by LED.

12. The dishwasher of claim 11, wherein the transparent surface has an edge region, and further comprising a plurality of LED units associated with the edge region of the transparent surface.

13. The dishwasher of claim 1, wherein the lighting unit comprises a rear holding frame.

14. The dishwasher of claim 1, further comprising a seal associated with the lighting unit, said seal encircling the through-hole of the at least one of the walls and being deformable when subjected to pressing.

15. The dishwasher of claim 1, wherein another one of the plurality of walls forms a door, said at least one of the walls forming a back wall which is located in opposite relation to the door and associated with the lighting unit.

16. The dishwasher of claim 1, further comprising a plurality of said lighting unit associated with the at least one of the walls and arranged in a pattern side by side and/or one above the other.

17. The dishwasher of claim 16, wherein the plurality of said lighting unit defines two lighting units provided side by side and three lighting units provided one above the other.

18. The dishwasher of claim 1, wherein the lighting unit forms a rectangular shape having edge lengths between 15 and 20 centimeters.

19. The dishwasher of claim 1, wherein the through-hole is provided in the at least one of the walls at a location where the at least one of the walls has impressed fields or troughs following its production.

* * * * *